United States Patent [19]

Saunders

[11] Patent Number: 5,014,536

[45] Date of Patent: May 14, 1991

[54] METHOD AND APPARATUS FOR DRAWING SHEET METAL CAN STOCK

[75] Inventor: William T. Saunders, Weirton, W. Va.

[73] Assignee: Weirton Steel Corporation, Weirton, W. Va.

[21] Appl. No.: 831,624

[22] Filed: Feb. 21, 1986

Related U.S. Application Data

[63] Continuation-in-part of Ser. No. 712,238, Mar. 15, 1985, abandoned.

[51] Int. Cl.[5] ..... B21D 22/20; B21D 51/26

[52] U.S. Cl. ..... 72/349; 72/347; 72/350; 220/72; 220/458

[58] Field of Search ..... 72/347–351, 72/42; 220/70, 72, 1 BC, 15, 66, 454, 458

[56] References Cited

U.S. PATENT DOCUMENTS

| | | | |
|---|---|---|---|
| 3,272,383 | 9/1966 | Harvey | 220/66 |
| 3,509,754 | 5/1970 | Massinggill et al. | 72/349 |
| 3,785,311 | 1/1974 | Yoshikawa | 72/348 |
| 3,832,962 | 9/1974 | Rolles | 220/458 |
| 3,905,507 | 9/1975 | Lyu | 220/66 |
| 3,934,527 | 1/1976 | Saunders | 220/458 |
| 4,054,227 | 10/1977 | Saunders | 220/458 |
| 4,264,017 | 4/1981 | Karas et al. | 220/70 |
| 4,404,836 | 9/1983 | Saunders | 72/338 |
| 4,405,058 | 9/1983 | Phalin | 220/458 |
| 4,412,440 | 11/1983 | Phalin et al. | 72/349 |
| 4,425,778 | 1/1984 | Franek | 72/349 |
| 4,450,977 | 5/1984 | Colburn et al. | 220/458 |
| 4,485,663 | 12/1984 | Gold | 72/347 |
| 4,507,339 | 3/1985 | Carbo et al. | 220/454 |
| 4,515,284 | 5/1985 | Lee et al. | 220/66 |
| 4,522,049 | 6/1985 | Clowes | 72/349 |
| 4,584,859 | 4/1986 | Saunders | 72/349 |
| 4,646,930 | 3/1987 | Karas et al. | 220/66 |

FOREIGN PATENT DOCUMENTS

| | | | |
|---|---|---|---|
| 804093 | 2/1981 | U.S.S.R. | 72/350 |

OTHER PUBLICATIONS

Modern Metals, Oct. 1962, "Design for Drawing Aluminum" pp. 68, 70, 71 and 74.

*Primary Examiner*—Robert L. Spruill
*Attorney, Agent, or Firm*—Raymond N. Baker

[57] ABSTRACT

New technology for deep drawing can bodies for use in the manufacture of two-piece cans for food and beverage products from precoated flat-rolled sheet metal can stock in which damage to can stock precoated on both surfaces with an organic coating is avoided and draw-forming of the side wall is controlled to decrease metal requirements. A draw die cavity entrance (47, 74) is selected to provide at least a major portion of its curvilinear surface having a radius of curvature of about five times nominal sheet metal thickness gage, or less, e.g. a maximum radius of curvature of 0.04 inch is used for the more commonly used can stock materials. During cup redraw, nesting of curvilinear clamping surfaces (21, 26) of the prior art is eliminated; the compound curvilinear juncture of a work product cup, between its end wall and side wall, is reshaped about a clamping ring compound curvilinear transition zone (72) of smaller surface area than the cup juncture and, the sheet metal is clamped solely between planar clamping surfaces (63, 71) during redraw to a smaller diameter utilizing a male punch (66) with a punch nose (79) having a significantly larger surface area than that of the cavity entrance zone.

20 Claims, 6 Drawing Sheets

FIG. 14
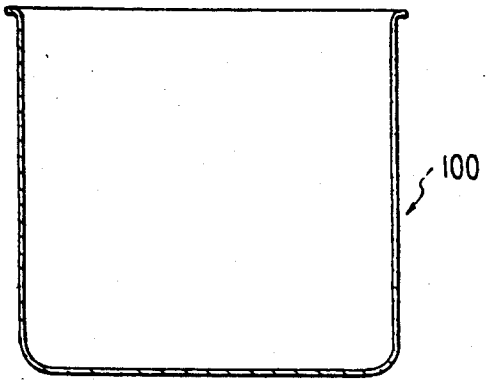
FIG. 15
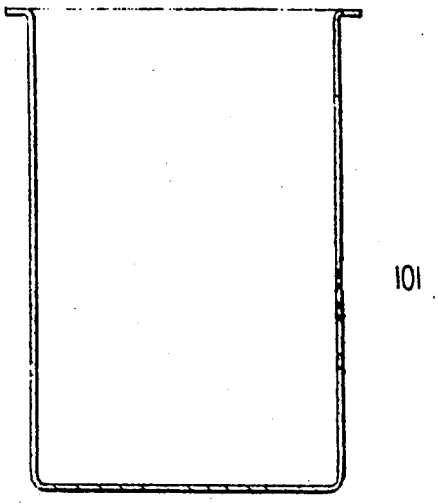
FIG. 16
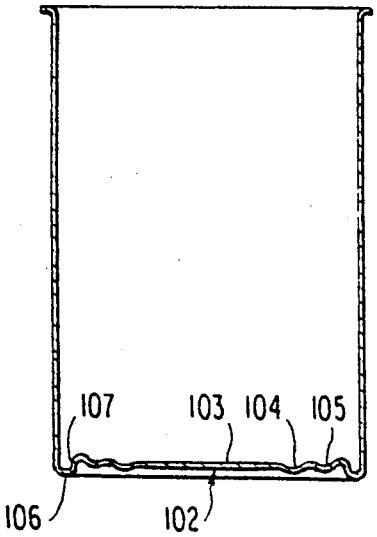
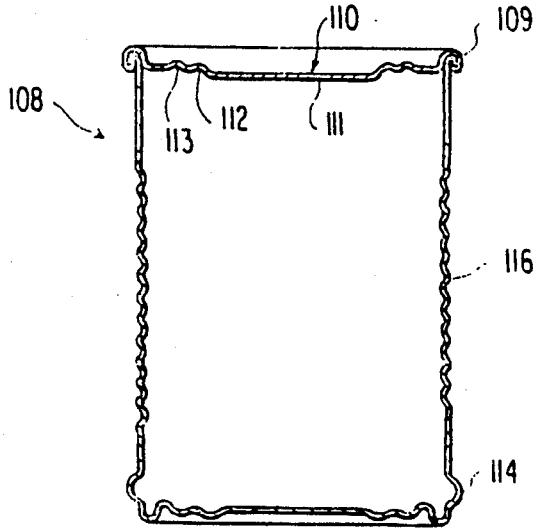
FIG. 17
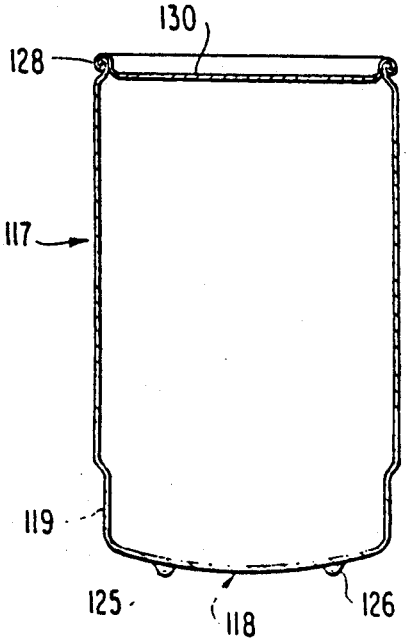
FIG. 18
FIG. 19
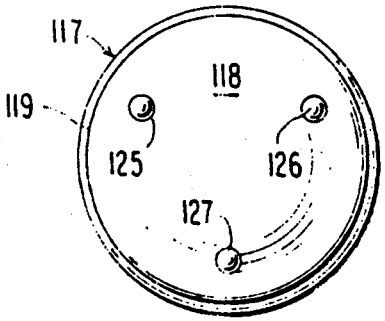

METHOD AND APPARATUS FOR DRAWING SHEET METAL CAN STOCK

This application is a continuation in part of copending application Ser. No. 712,238, filed Mar. 15, 1985, now abandoned.

This invention relates to new can-making processes, apparatus and can products. More particularly, this invention is concerned with processing organically coated flat-rolled sheet metal into drawn can bodies for use in the manufacture of two-piece cans and, in one of its more specific aspects, is concerned with processing precoated flat-rolled sheet metal for direct use in canning food products.

One specific application for the invention involves cylindrical sanitary cans which must be able to withstand vacuum packing and post packing sterilization of canned foods and beverages. There has been an increasing demand to replace soldered can bodies with a can body which does not use lead in any form in contact with food products. Major efforts continuing for more than a decade have been directed toward development of a solder-free two-piece can fabricated with a unitary can body of suitable height made by progressively drawing and redrawing flat-rolled sheet metal. However, two-piece cylindrical sanitary cans have not been commercially competitive with the three-piece can in the can sizes desired for packing fruits, vegetables, soups, and the like which require deep-drawn can bodies.

In prior efforts to fabricate suitable unitary can bodies by deep drawing operations, the sheet metal thickened along the side wall height, increasing in going from the bottom wall toward the open end of the can body, so that the metal economics were not commercially acceptable. One approach, attempting to overcome that problem, provides tooling for thinning such draw thickened side wall metal by forcing the mandrel-mounted can through a restricted opening die (see e.g. U.S. Pat. No. 4,485,663); essentially, this involves ironing or burnishing of the thickened side wall metal. However, such an approach can create additional problems if the can body is driven through the tooling. Also, the open end of the can body is increased in height irregularly presenting ragged-edge formations from which small pieces of metal are broken off; these contaminate tooling and subsequent can making, and the irregular open end of the can body requires costly rotary shearing (in a direction transverse to the can axis) and flange metal orientation.

A major obstacle in any draw technology existent prior to the present invention has been the extent of damage to protective coatings applied prior to draw operations. Because of such damage to protective coatings, especially organic coatings, the use of precoated sheet metal in the manufacture of drawn can bodies had restricted application unless provisions were made for coating repair subsequent to can body fabrication. This has been a significant factor in preventing two-piece cans which require deep drawn can bodies from being commercially competitive with most three-piece sanitary cans for food products. Also, deep drawn can bodies have not previously been commercially competitive with drawn and ironed can bodies for pressurized contents such as carbonated beverages.

The present invention surmounts these obstacles by providing new methods and apparatus which enable commercially competitive manufacture of deep drawn can bodies for vacuum packed and carbonated beverage cans from flat-rolled sheet metal precoated on both surfaces with an organic coating. New tooling configurations and relationships are provided which enable draw process production of unitary can bodies from flat-rolled sheet metal having an organic coating, of the type required for comestibles, on both surfaces without detriment to the metal or protective coating.

These and other advantages and contributions of the invention are considered in more detail in describing embodiments of the invention as shown in the accompanying drawings. In these drawings.

Figure 7:
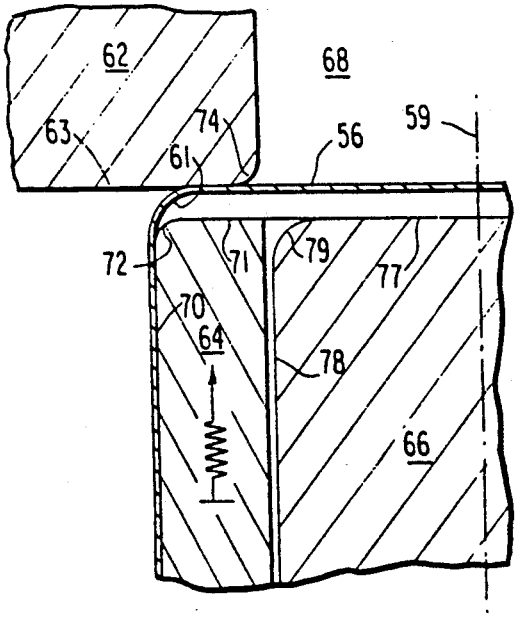
FIG. 7 is a schematic cross-sectional partial view of tooling in accordance with the present invention as arranged before start of redraw of a new cup diameter.
Figure 13:
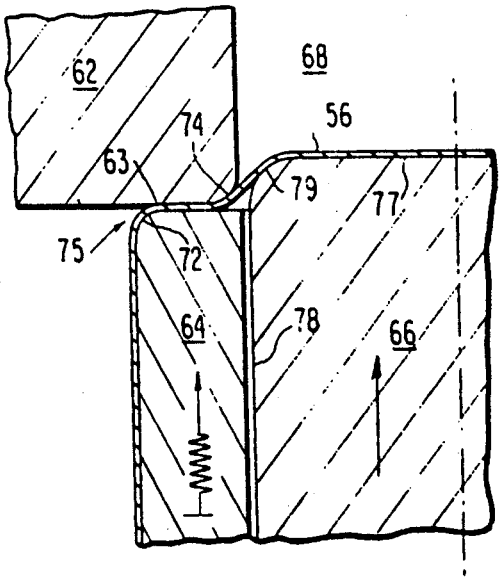
Figure 12:
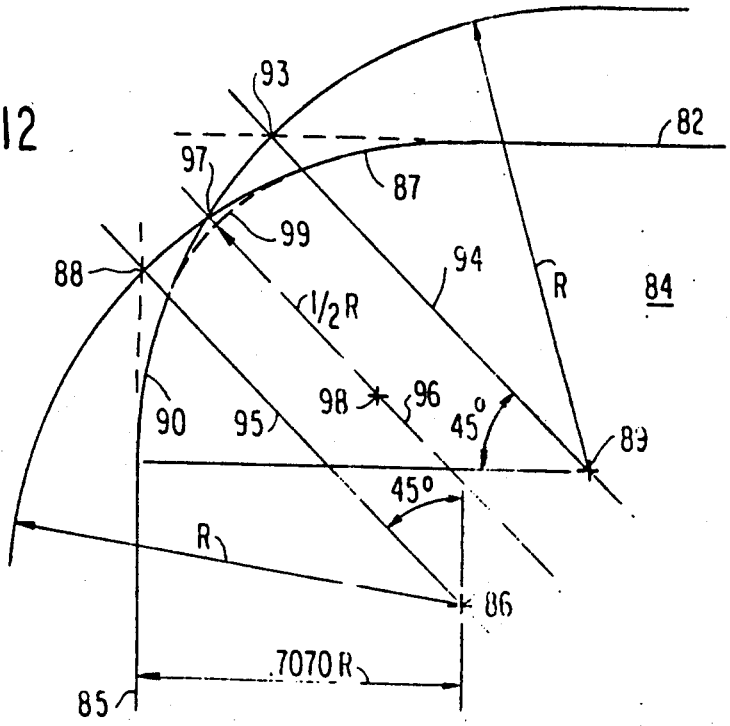

FIGS. 8, 9, 10, and 11 are schematic cross-sectional partial views of apparatus and work product illustrating the sequential steps in accordance with the invention for reshaping the compound curvature juncture, between the end wall and side wall of a cup, in preparation for drawing a new cup diameter;

FIG. 12 is an illustration for describing manufacture of a multiple radii surface for use at the compound curvature transition zone, between the end wall and external side wall of a clamping ring, in accordance with the invention;

FIG. 13 is a schematic cross-sectional partial view of the apparatus of FIG. 7 at the start of formation of a new cup diameter;

FIG. 14 is a cross-sectional view of a redrawn can body in accordance with the present invention;

FIG. 15 is a cross-sectional view of a double-redraw can body in accordance with the present invention;

FIG. 16 is a cross-sectional view of a deep drawn can body showing bottom wall profiling in accordance with the present invention;

FIG. 17 is a cross-sectional view of a two-piece can showing bottom wall profiling and side wall profiling including a chime profile contiguous to the closed end of a deep drawn can body in accordance with the present invention.

Figure 20:
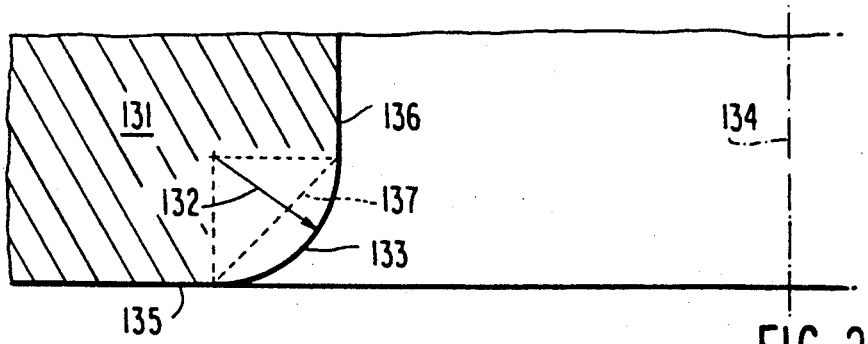
Figure 21:
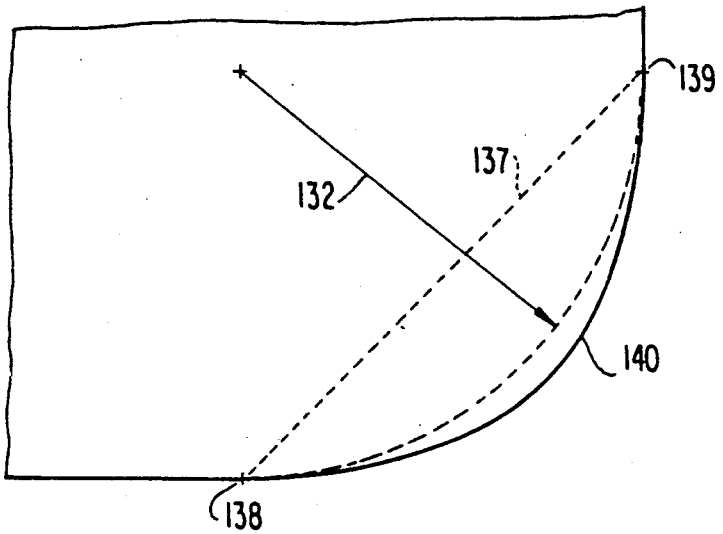
Figure 22:
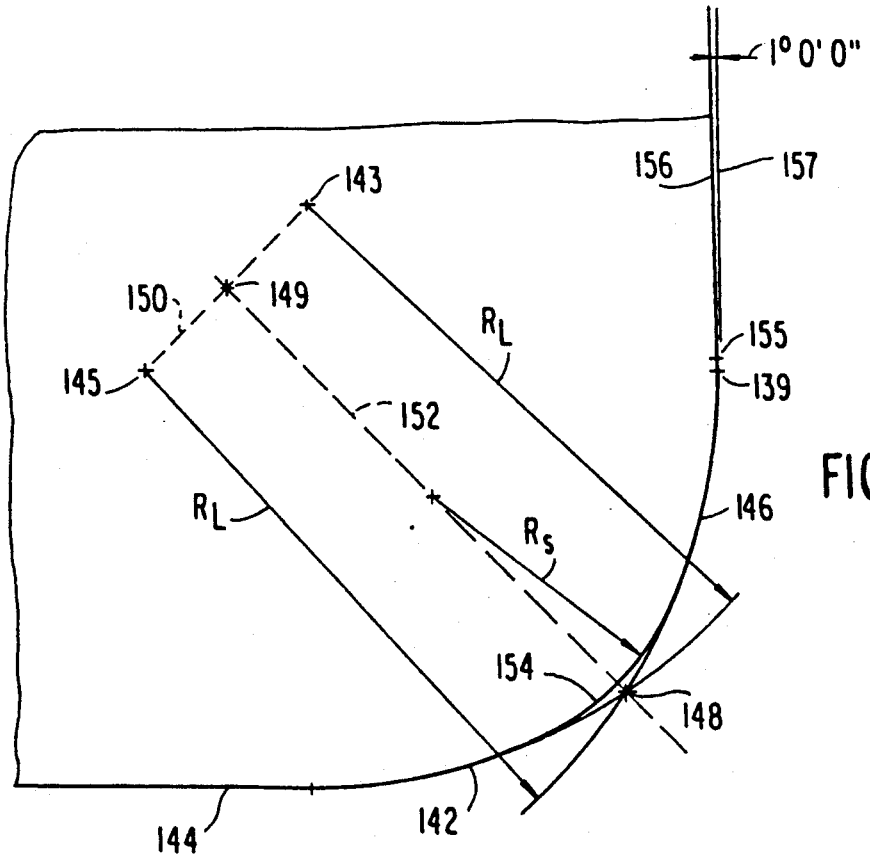

FIG. 18 is a cross sectional view of a two-piece beer and carbonated beverage can embodying a deep drawn can body in accordance/with the invention;

FIG. 19 is a bottom plan view of the can body of FIG. 18;

FIGS. 20, 21 and 22 are radial cross-sectional views of portions of a draw die for describing configurational aspects of a cavity entrance zone in accordance with the invention; and FIGS. 23, 24, 25, and 26 are schematic cross-sectional partial views of apparatus illustrating final redraw, release and bottom wall profiling of a sheet metal work product in accordance with the invention.

Figure 1:
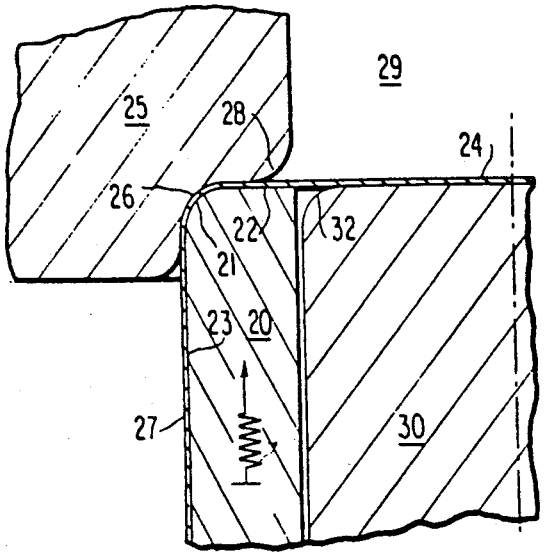
FIG. 1 PRIOR ART
FIG. 1 is a schematic cross-sectional partial view of prior art tooling with sheet metal clamped between compound curvature surfaces immediately prior to start of redraw of a new diameter.
Figure 2:
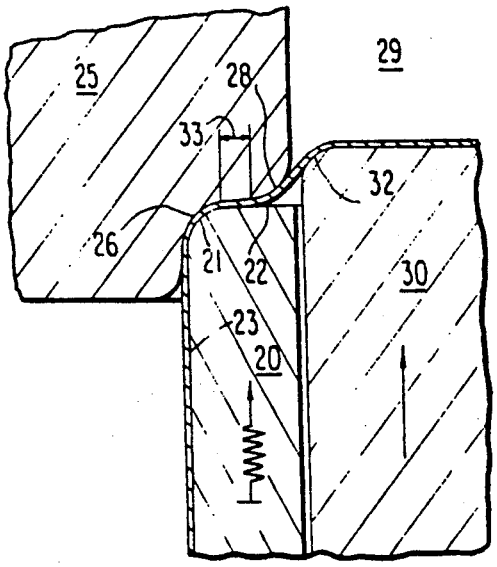
FIG. 2 PRIOR ART
FIG. 2 is a schematic cross-sectional partial view of the prior art tooling of FIG. 1 as the new diameter is being formed.

Prior art redraw technology for can body manufacture relied on nesting of compound curvature (curvilinear as shown in cross section in FIGS. 1 and 2) clamping surfaces. An objective, as part of such nesting arrangement, was to have the curvilinear clamping surfaces match the compound curvature (curvilinear in cross section) juncture between the end wall and side wall of a cup-shaped work product while redrawing the cup-shaped work product to a smaller-diameter cup with increased side wall height. Toroidal configuration clamping ring 20 had a radius of curvature at its curvilinear transition zone 21, between its planar surface end wall 22 and side wall 23, which was designed in the prior art to match, as closely as possible, the radius of curvature of the internal surface at the curvilinear juncture of the end wall and side wall of cup 24. Also, draw die tooling 25 had a curvilinear clamping surface 26; the attempt was made, while allowing for metal thickness, to clamp over the entire outer compound curvature surface area of sheet metal 27. The random and excessive increase in side wall sheet metal thickness experienced with prior art drawing technology added to the difficulties in attempting to obtain full surface clamping.

Also, in accordance with prior technology, radius of curvature 28, at the entrance of cavity 29, was preselected to be as large as possible without wrinkling the sheet metal during relative movement of male punch 30 into die cavity 29 (FIG. 2); and, radius of curvature 32, at the nose portion of male punch 30, was selected to be as small as possible without causing punch out of metal. Typically, prior art radius of curvature dimensions for the tooling during the first redraw operation in forming a 211×400 can (2-11/16" diameter by 4" height) were as follows

| | |
|---|---|
| clamping ring surface "21"-.125" | cavity entrance radius "28"-.070" |
| draw die surface "26"-.135" | punch nose radius "32"-.125" |

Thickening of the side wall metal was not desirably controlled during drawing or redrawing operations in the prior art. Reasons for this may possibly be related to dimensional relationships of the tooling, inadequate clamping of the sheet metal provided by the compound curvature clamping surfaces and/or the small planar clamping surface area available (represented by radial dimension 33 in FIG. 2). However, it is known that prior deep drawing technology produced can bodies in which side wall metal thickened in excess of 15% and up to about 25% (over starting gage) in approaching the open end of the can body.

Figure 3:
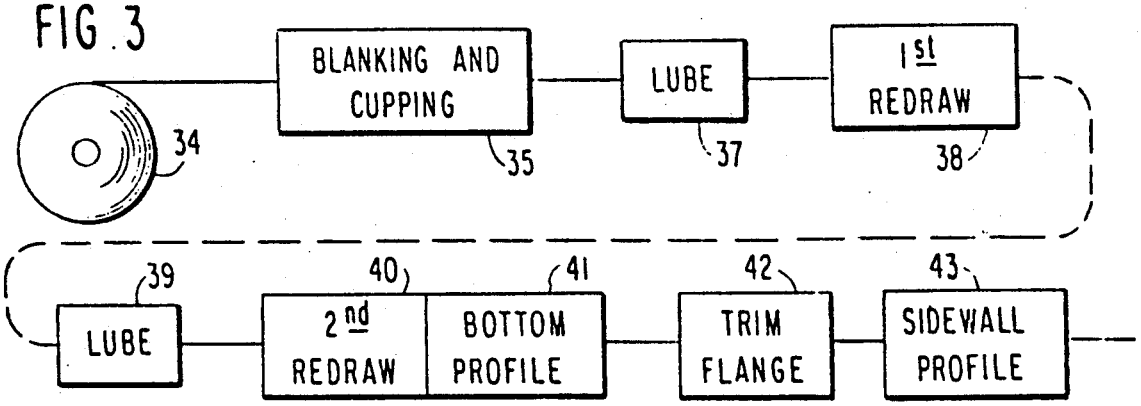
FIG. 3 is a diagrammatic presentation of the overall process steps and apparatus combination of the present invention for direct fabrication of one-piece can bodies for use in the manufacture of two-piece cans.

With the new technology being presented, side wall thickening is substantially eliminated, or controlled, and organically coated flat-rolled sheet metal mill product can be processed directly into can bodies ready for use without special flange metal orientation or can body repair steps of any nature. Referring to FIG. 3, can stock of predetermined gage, coated on both its planar surfaces with an organic coating, is uniformly lubricated on both such surfaces and delivered from coil 34 to blanking and cupping station 35. A large-diameter shallow-depth cup is formed from the sheet metal blank of predetermined diameter so as to present flange metal oriented in a plane substantially perpendicularly transverse to the central longitudinal axis of the cup. Draw surfaces of such cup can be re-lubricated at station 37 prior to a first redraw operation at station 38 in which the original cup diameter is decreased and its side wall height increased; flange metal is properly oriented for chime seam usage as part of the draw-technology teachings of the present invention.

Preferably, cup draw surfaces are re-lubricated before each redraw. In a specific embodiment with two redraw operations, the first-redraw cup is lubricated at station 39 prior to a second redraw at station 40. In this double-redraw embodiment, the cup is redrawn at station 40 to final dimensions of desired diameter and side wall height with flange metal in place substantially perpendicularly transverse to the can body's central longitudinal axis. Lubricants acceptable for food product cans (e.g. petrolatum) are utilized. Flat-rolled strip lubricators have been known in the art. However, the present teachings provide for re-lubricating work product cup surfaces before each redraw operation as may be required while enabling direct utilization of a redrawn can body, without washing or other can body preparation steps, in can manufacture. For such purposes atomized liquid cup lubrication apparatus is provided; in which a lubricant (such as petrolatum) in liquid form is atomized in an atomization chamber and liquid lubricant particles are transported pneumatically into a lubricant deposition chamber. Such particles are directed for flow-impingement on both interior and exterior cup surfaces; and, electrostatic charging can be used to augment re-lubrication of exterior cup surfaces suitable cup re-lubrication apparatus is disclosed in copending U.S. application Ser. No. 011,112, entitled "Lubrication of Cup-Shaped Can Bodies, " filed Feb. 5, 1987, now U.S. Pat. Nos. 4,724,155, dated Feb. 8, 1988, and No. 4,831,960, dated May 23, 1989, which are included herein by reference.

As a final-redraw can body is freed from draw die tooling, bottom profiling is carried out with apparatus at station 41. Thus bottom profiling is carried out on the same press used for the final redraw. The type of flange metal trimming carried out at station 42 is dependent on can usage. If the open end of the can body is to be necked-in for a particular type of carbonated beverage can, the transversely oriented flange metal can be removed for the necking-in operation. Full periphery flange metal is provided for other types of cans and is properly oriented at the completion of the redraw, i.e. flange metal orientation is not required. Also, trimming is simplified; rotary shearing is eliminated and replaced by trimming in a direction parallel to the centerline axis of the can. Side wall profiling is carried out at station 43.

Sanitary can bodies are then ready for direct use by filling, completing closure with a chime seam and heat process treatment of contents using apparatus known in the art. Such direct processing of deep drawn can bodies into cans was not previously available without coating repair, washing or other can body preparation steps.

Teachings of the present invention enable one-piece cylindrical can bodies to be deep drawn from flat-rolled sheet metal, coil-coated on both surfaces with an organic coating, without damage to the metal or coating. This can stock is controlled during draw and redraw operations enabling can body product of the present invention to meet or exceed metal economics requirements so as to be commercially competitive with drawn and ironed can bodies for pressurized two-piece cans and, also, with three-piece cylindrical sanitary cans shown or described in the "Dewey and Almy Can Dimension Dictionary" published by the Dewey and Almy Chemical Division, W. R. Grace & Co., Cambridge, Mass. 02140. While the metal economics requirements of the can body, per se, can be met with the present invention across the full spectrum of standard three-piece cylindrical sanitary can sizes, capital requirements for extended stroke (above e.g. about five and one-half inches) presses and market volume for such extended height cans are factors which have a bearing in commercial application. Considering these factors, a preferred range for commercial application of the invention covers standard can sizes with diameters between about two inches to about four and one-quarter inches, and side wall heights between above one inch to about five inches; representative tooling dimensions and relationships for can sizes in such preferred commercial range are set forth later herein.

The invention departs, initially, from the conventional can body draw die design technology which taught that the draw die cavity entrance radius should be selected to be as large as possible without forming buckles during forming of high tensile strength light gage sheet metal. In place of such prior teachings, cupping of a sheet metal blank is carried out using a die cavity having an entrance zone including a surface formed from a radius of curvature which is selected to be as small as practicable, e.g. about five times can stock starting thickness but having a maximum value of about 0.04" for standard can stock gages.

The invention also teaches use of a significantly larger punch-nose radius of curvature than taught in the prior art, e.g. about forty times starting gage in first drawing a cup from a can stock blank. Such punch-nose radius can be partially dependent on the cup diameter being drawn. In the first draw for fabricating a soup can (211×400) from 65 #/bb flat-rolled steel, punch nose radius is selected at 0.275"; this radius of curvature is practical for the range of can size diameters set forth above.

Figure 4:
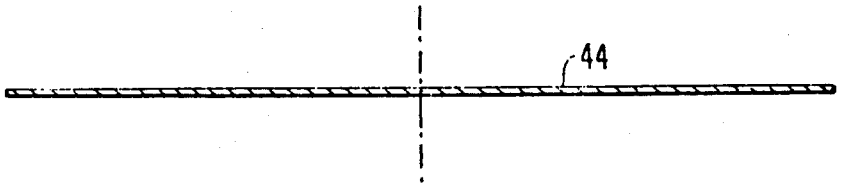
FIG. 4 is a cross-sectional view of a circular blank.
Figure 5:
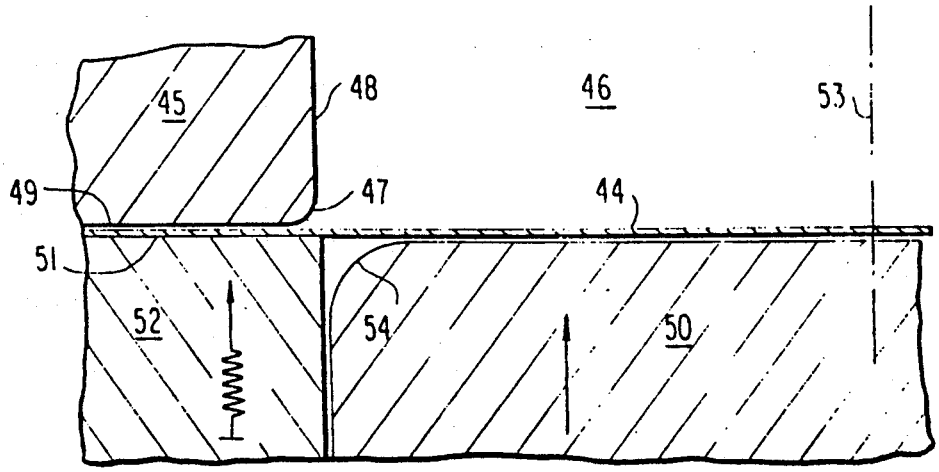
FIG. 5 is a schematic cross-sectional partial view of tooling for drawing a cup-shaped article from a circular blank in accordance with the invention.

FIG. 4 shows a can stock blank 44 of predetermined thickness gage and diameter which is draw formed into a work product cup with tooling as partially shown in the cross-sectional schematic view of FIG. 5. Draw die tool 45 defines cavity 46 with compound curvilinear entrance zone 47 between its internal side wall 48 and a planar clamping surface 49. Male punch 50 moves relative to die cavity 46 as indicated as the circular blank 44 is clamped, about its periphery radially exterior to male punch 50, between planar clamping surface 49 of draw die 45 and planar surface 51 of clamp ring 52; such planar clamping surfaces are perpendicularly transverse to centerline axis 53. The cavity entrance zone 47 includes a 0.040" radius surface, or smaller radius surface, dependent on can stock thickness gage; punch-nose radius 54 presents a significantly larger surface area than that of the cavity entrance zone 47.

Figure 6:
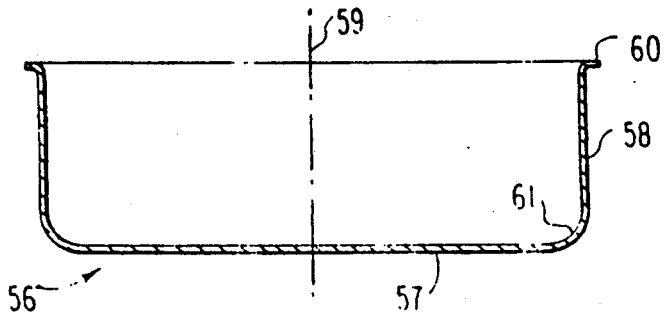
FIG. 6 is a cross-sectional view of a cup-shaped article in accordance with the invention.
Figure 8:
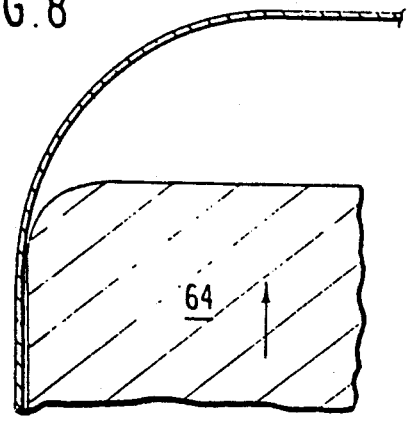
Figure 9:
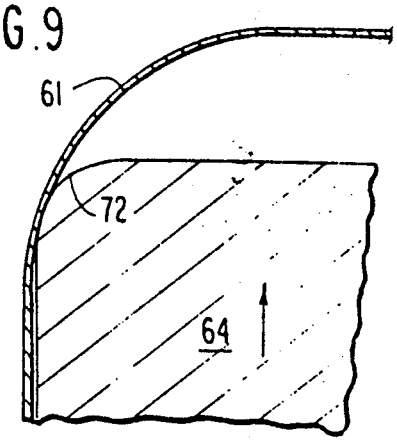
Figure 10:
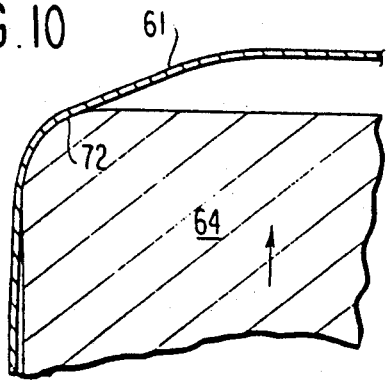
Figure 11:
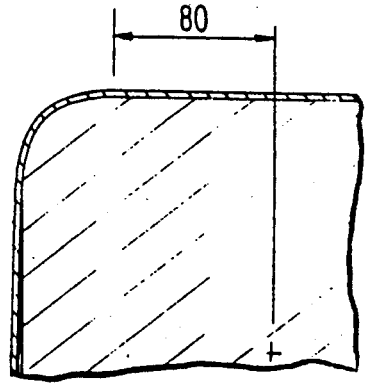

Drawn cup 56 (FIG. 6) includes end wall 57, side wall 58 which is symmetrically spaced from centerline axis 59, flange metal 60 which lies in a plane which is substantially perpendicularly transverse to axis 59, and a curvilinear juncture 61, between end wall 57 and side wall 58, having a curvature conforming to that of punch nose 54 of FIG. 5.

During redraw, the prior nesting arrangement of curvilinear clamping surfaces is eliminated. In the new technology, the cross-sectional curvilinear juncture between the end wall and side wall of a work product cup being redrawn is reshaped initially in a manner which creates radially outwardly directed force on the can stock and prevents wrinkling of the sheet material. This reshaping of the curvilinear juncture also significantly increases the surface area of the metal available for clamping between planar, surfaces during redraw.

FIG. 7 shows the juxtaposition of redraw tooling and a drawn cup 56 in approaching a redraw operation. Draw die tool 62 can be considered as stationary for purposes of explaining this embodiment, it being understood that the required relative movement between tool parts can be carried out with various movements of the upper or lower tooling with their centerline axes coincident. In FIGS. 5, and 7, and later apparatus figures, the open end of the cup is oriented downwardly during formation.

The invention teaches use of a "flat face" draw die for redraw operations as shown in FIG. 7. I.e, first-redraw die 62 presents solely planar clamping surface 63 lying in a plane which is perpendicularly transverse to centerline axis 59. Movable clamping ring 64, which is substantially toroidal in configuration, is disposed to circumscribe cylindrically shaped male punch 66. The latter is adapted to move within cavity 68, defined by draw die tool 62, while allowing clearance for work product thickness (sheet metal including coating; e.g. about 0.010" around the full periphery for organically coated 65 #/bb steel plate; i.e. about one and one-half times thickness of the precoated sheet metal.

Clamping ring 64 includes external side wall 70, planar end wall 71 and curvilinear transition zone 72 therebetween. The outer diameter (peripheral side wall 70) of clamping ring 64 allows only for tool clearance (about 0.0025") in relation to the side wall internal diameter of a work product cup such as 56.

In accordance with present teachings, the surface area of transition zone 72 of clamping ring 64 is significantly smaller than the surface area of juncture 61 of cup 56; i.e. a projection of the transition zone 72 onto a clamping surface plane which is perpendicularly transverse to the centerline axis occupies significantly less radial distance, i.e. less than about 40% along that plane, than a projection of cup juncture 61 (this is shown in more detail in FIGS. 8–11). The interrelationship of these curvilinear surfaces is selected to provide a difference of at least 60% in their projections on the transverse clamping plane; this translates into a corresponding increase in planar clamping surface area when juncture 61 is reshaped by transition zone 72 as shown in FIGS. 8–11.

In a specific embodiment, a 0.275" radius of curvature at cup juncture 61 projects on the transverse clamping plane as 0.275"; the projection of transition zone 72 occupies 0.071"; this provides about a 75% difference; i.e. a projection of the clamping ring transition zone (72) onto the transverse clamping plane occupies about 25% of the projection of the 0.275" radius of curvature of juncture 61. This significantly increases the toroid-shaped planar clamping surface area, peripheral to the punch, over that which would be available through use of the curvilinear surface nesting arrangement of the prior art.

As clamping ring 64 is moved against springloaded pressure, transition zone 72 comes into contact with the inner surface of juncture 61 of cup 56; with continued relative movement, a radially outwardly directed force is exerted on the sheet material of cup 56 as juncture 61 is reshaped (FIGS. 8–11). Upon completion of such reshaping, the sheet material is clamped solely between planar clamping surfaces during redraw of a new diameter; clamping takes place, over an extended planar surface area, between draw die planar clamping surface 63 and clamping ring planar surface 71. The total planar clamping surface area is significantly increased, over that previously available, due to such controlled reshaping of juncture 61 about clamping ring transition zone 72; and, it is also increased because of the smaller projection of the cavity entrance of curvature 74 on the transverse clamping plane. As previously stated, such die cavity entrance radius does not exceed 0.040" which is significantly less than taught by the prior art. Combining the effect of reshaping the cup juncture and use of a smaller cavity entrance zone projection increases the planar clamping surface available by a factor of at least two over that available with the prior art nesting arrangement.

The reshaping of curvilinear juncture 61 of the cup 56 is shown sequentially in FIGS. 8, 9, 10, and 11 with relative movement of clamping ring 64 as indicated. The increase in planar clamping surface is represented by radial cross-sectional dimension 80, which extends around the full periphery. During such reshaping, a radially outwardly directed force is exerted uniformly on the sheet material, around the full 360°, preventing wrinkling of the sheet metal.

The concept of reshaping the peripheral juncture metal at the closed end of a work product cup about a smaller curvilinear surface area than the cup juncture adds planar clamping surface area as taught above. An additional contribution of the invention involves manufacture of the clamping ring peripheral transition zone about multiple radii which further adds to planar clamping surface area, and has other advantages.

This multiple radii concept is described in relation to FIG. 12. A single radius of curvature for the clamping ring peripheral transition zone about a radius "R",would result in a projection on the transverse clamping plane of clamping ring end wall 82 dimensionally equal to "R". In place of such single radius, a multiple radii curvature is provided through selective usage of "large" and "small" radii of curvature in forming the compound curvature transition zone for a clamping ring.

In FIG. 12, clamp ring 84 includes planar end wall 82 (defining the transverse clamping plane perpendicular to the centerline axis of the cup) and peripheral side wall 85. In preferred fabrication of the clamp ring transition zone, a radius R ("large") is used about center 86 to establish circular arc 87, which is tangent to the planar surface of clamping end wall 82. Extending circular arc 87 through 45° intersects the extended plane of side wall 85 at imaginary point 88. Using the radius R about center 89 establishes circular arc 90 tangent to side wall 85; extending arc 90 through 45° intersects the transverse clamping plane of end wall 82 at imaginary point 93. Straight line 94 is drawn between point 93 and center 89; straight line 95 is drawn between point 88 and center 86; line 96 is drawn to be equidistant between parallel lines 94, 95. Line 96 comprises the loci of points for the center of the "small" radius of curvature which will be tangent to the circular arcs 87 and 90 so as to avoid their abrupt intersection at imaginary part 97. Using a radius of ½ R with its center 98 along line 96, circular arc 99 is drawn, to complete a smooth multiple-radii compound curvature for the transition zone of clamping ring 84.

As a result of the die design of FIG. 12, the projection of the multiple-radii compound curvature on the transverse clamping plane of end wall 82 is 0.0707 times R; resulting in an increase of almost 30% (29.3%) in the planar clamping surface over that available if a single radius R were used for the compound curvature transition zone of clamping ring 84. Also a more graduated entrance curve 87 to the transverse clamping plane is provided; and a more gradual entrance curve 90 is provided for entrance of the clamping ring onto the internal surface of the compound curvature juncture of the drawn cup for the reshaping step.

In a specific embodiment for the multiple-radii clamping ring transition zone for reshaping a 0.275" radius of curvature for work product cup 56, R is selected to be 0.100"; therefore the projection of the clamping ring multiple-radii transition zone on the transverse clamping plane comprises 0.0707"; rounded off as 0.071". Other values for R can be selected, e.g. 1.25" for reshaping a cup juncture of substantially greater radius than 0.275"; or 0.9" for reshaping a smaller radius of curvature juncture; in general selecting R as 0.100" will provide desired results throughout the preferred commercial range of can sizes designated.

A funnel-shaped configuration 75 (as shown in cross section FIG. 13) is established between planar surface 63 of draw die 62 and clamping ring transition zone 72 for movement of work product sheet material into the axially transverse clamping plane, without damage to the coating, as male punch moves into cavity 68; a further relief can be provided by having surface 63 diverge away from the clamping plane at a location which is radially exterior to the planar clamping surface. Male punch 66 includes end wall 77, peripheral side wall 78 and curvilinear transition zone 79 therebetween. In contrast to the small surface area of cavity entrance zone 74, a large surface area is provided at "punch-nose" 79. Overcoming the inertia of starting a new diameter is facilitated by such selection of a relatively large surface area for punch-nose 79. Coaction between such large surface area punch-nose, a small radius of curvature cavity entrance zone surface, and the elimination of the prior art curvilinear nesting arrangement, with accompanying increase in planar clamping surface area during redraw, combine to continue control of side wall sheet material which was initiated during the cupping step and prevent unacceptable thickening of such sheet material (e.g. of the type which would damage an organic coating). Through use of the present invention, side wall thickness gage is decreased through substantially the full side wall height; any minor increase in thickness which might occur is limited to a level contiguous to the open end flange metal. That is, if side wall thickening occurs, it is limited to this single level and, any increase in thickness at such level is substantially less than the prior art experience of 15% to 25%; e.g. about 10% or less with the present invention. In double-redraw practice in the above preferred range of can sizes, increase in side wall thickness contiguous to open-end flange metal, if any, has been minor, i.e. less than 3%.

The punch nose radius for a first redraw is selected to be about thirty times starting metal thickness gage; e.g., in the specific embodiment for a 211×400 can, 65 #/bb steel, the first-redraw punch-nose radius is 205".

The same multiple radii compound curvature which projects as, 0.071" on the transverse clamping plane can be used, for convenience, in reshaping this compound curvature juncture (which has an internal surface radius of curvature of 0.205") during the second redraw; or a new surface based on R=0.9" can be used in forming the multiple radii transition zone for the second redraw clamping ring as described above.

FIG. 13 shows the apparatus of FIG. 7 at the start of new diameter formation. Typical values for deep drawing a can body for a 211×400 size can from precoated 65 #/bb flat-rolled steel in accordance with the invention are as follows:

| Work Product | Diameter | Punch-Nose Radius | Cavity Entrance Radius | Projection of Clamp Ring Transition Zone |
|---|---|---|---|---|
| Circular blank | 6.7" | — | — | — |
| Shallow cup (first draw) | 4.4" | .275" | .028" | — |
| First-redraw cup | 3.2" | .205" | .028" | .071" |
| Second-redraw cup | 2.5" | .062" | .028" | .071" |

Typical sheet metal clearance in each draw is approximately 1.5×sheet material thickness or 0.010" to 0.012" per side (in cross section) for precoated 65 #/bb flat-rolled steel.

In practice of the invention, a sheet metal blank diameter is decreased about 25% to 40% during cupping and the work product cup diameter is decreased about 15% to 30% in a first redraw; the diameter of a first-redraw cup is decreased about 15% to 30% when second redraw is utilized.

Typical diameters for a double-redraw embodiment (can size 300×407) are:

| | |
|---|---|
| circular blank | 7.6" |
| first draw | 5.2" |
| first redraw | 3.6", and |
| second redraw | 2.9" |

Typical diameters for a single redraw embodiment (can size 307×113) are:

| | |
|---|---|
| circular blank | 6.2" |
| first draw | 4.0" |
| redraw | 3.3" |

The punch nose radius of curvature in a final redraw is selected based on requirements of can geometry; i.e. the desired radius of curvature at the closed end of the final redraw can body; e.g. about ten times starting gage of the sheet material.

A first redraw can body 100 is shown in FIG. 14 and a second redraw can body 101 is shown in FIG. 15. In each instance, flange metal at the open end of the can is oriented transversely to its centerline axis.

Using prior art draw-redraw technology on organically coated tin-free steel for a can body for a 211×400 can size, the average increase in side wall sheet metal thickness at the open end of the double-redraw can body was about 17.5%. When the circumferentially-distributed average thickness, measured at about ¼" increments over the entire side wall longitudinal dimension is compared, such prior art can body side wall had an average thickness about equal to starting gage (0.0075" which is nominal 65 #/bb flat-rolled steel can stock with organic coating); whereas with the present invention, such average side wall thickness was 12.7% less than the starting gage. These data correspond to starting blank area requirements in practice of the present invention; the starting blank area is about 12% less with the present invention than the starting blank area requirement of the prior art; e.g. in a specific embodiment of the invention for a can body for a 211×400 can size, the starting blank diameter of 6.718"; the starting blank diameter with prior art draw-redraw technology was 7.267".

As stated, with prior draw-redraw technology, the metal increased in thickness along the side wall with the increase over starting gage reaching from about 15% to 25% at the open end of the can body. With the present invention, if any increase in side wall thickness occurs, it is minor and limited to a level contiguous to open end flange metal of the can body. Results of the present invention include an improvement in metal economics while maintaining adequate vacuum and crush-proof strength for the side wall.

In specific embodiments of the invention, an organically-coated, TFS steel substrate was fabricated into can bodies (as shown in FIG. 16) for 211×400 cans utilizing a first and second redraw; side wall gage was then measured at about 0.2" increments (tabulated as "A" through "S") starting at the open end and proceeding longitudinally throughout the side wall height. The percentage change in side wall thickness, measured around the circumference at each such incremental level, is set forth in the Table below. In Example #1, side wall thickness increased only slightly (less than 3%) solely at the first measurement location ("A"); decrease in thickness over side wall height averaged slightly less than 15%; in Example #2, side wall thickness decreases slightly at such location; average decrease in thickness slightly above 16%. Percentage changes in side wall thickness gage or nominal starting gage are shown:

TABLE

| Side Wall Measurement Locations Starting at 0.2" from Flange Metal of FIG. 16 | Percentage Reduction Example #1 % | Percentage Reduction Example #2 % |
|---|---|---|
| A | (2.2)* | 2.0 |
| B | 4.8 | 8.7 |
| C | 9.7 | 11.2 |
| D | 14.7 | 17.0 |
| E | 17.9 | 18.6 |
| F | 18.9 | 19.2 |
| G | 20.4 | 21.2 |
| H | 21.5 | 22.1 |
| I | 21.2 | 23.1 |
| J | 22.1 | 23.8 |
| K | 22.8 | 24.1 |
| L | 22.5 | 23.8 |
| M | 14.1 | 23.2 |
| N | 10.6 | 11.2 |
| O | 11.8 | 13.1 |
| P | 13.1 | 13.8 |
| Q | 14.4 | 14.1 |
| R | 13.8 | 14.4 |
| S | 7.4 | 4.1 |

*(Increase)

Additional novel tooling configuration concepts for the draw die further facilitate simultaneous multidirectional movement of precoated flat-rolled sheet metal during draw (cupping and/or redraw) operations while avoiding damage to either coating or sheet metal.

The difficulties in overcoming the inertia of the can stock during initiation of such multi-directional shape changes, and avoiding damage to the sheet material, increase as can body production rate is increased. In addition to facilitating desired movement of sheet material during draw operations, these difficulties are overcome without sacrificing draw die planar clamping surface area and while maintaining a desired radius for a major portion of the cavity entrance zone; i.e. a compound curvilinear surface portion formed about a radius which is about five times nominal starting thickness gage.

Also, the draw-operation reshaping method taught by the present invention is carried out while eliminating adherence of can stock along the draw die internal side wall surface which might damage the coating. Notwithstanding tooling clearances of about one and one-half times coated can stock gage, as taught above, the reshaping action required can cause the sheet material to follow the internal side wall surface of the draw die upon leaving the cavity entrance zone as the draw punch moves within the draw cavity. A change in cavity entrance zone configuration and a recessed taper for the internal side wall of draw die overcome this tendency.

As part of such novel draw die configurational concepts, the cavity entrance zone is reshaped to increase its surface area providing for a more gradual change in direction of movement of the coated sheet material during draw operations; and, also, providing better support of such can stock during its movement both into and from the cavity entrance zone. The surface area of the cavity entrance zone is increased by forming such surface area from multiple radii of curvature; such increase in surface area is provided without sacrificing smooth movement or support of the can stock during reshaping and without sacrificing planar clamping surface area provided by the draw die.

FIG. 20 shows an enlarged view of a cavity entrance zone for draw die 131 formed about, as previously described, a single radius of curvature 132 which is smaller than that used in the prior art. Single-radius curvilinear surface 133 is symmetrical about central longitudinal axis 134 and extends between planar clamping surface 135 and internal side wall 136. Such compound curvilinear surface 133 is tangential, at each end of its 90° arc (as measured in a radial plane) to planar surface 135 and side wall surface 136, respectively.

The objective in further improving the draw die of FIG. 20 is to increase the surface area of its cavity entrance zone in a manner which will provide for a more gradual movement of the can stock both into and out of such entrance zone; that is, in a manner less abrupt, and less likely to be damaging to the sheet material, so as to facilitate overcoming the inertia in the sheet material resisting the multi-directional reshaping action taking place as the draw punch moves into and out of the draw cavity. Support for the sheet material is improved during such reshaping. These objectives are achieved while maintaining the improved smaller area of projection of the cavity entrance zone on the clamping plane which is perpendicular to the central longitudinal axis 134. That is, these objectives are accomplished without decreasing the draw die planar surface area available for clamping. Also, these objectives are accomplished while a radius of about five (5) times can stock thickness gage (maximum of about 0.04" in a specific embodiment) is maintained for a centrally located major portion of the cavity entrance zone surface.

The concept of increasing the surface area of the cavity entrance zone is carried out by reshaping the entrance zone about multiple radii rather than a single radius while maintaining a continuously curvilinear smooth surface for support of the can stock sheet material.

In FIG. 21, the compound curvilinear surface 133 (about single radius of curvature 132 of FIG. 20) is shown in dotted lines; a 45° angle line 137, between the planar clamping surface and cavity side wall, is also shown in dotted lines; such 45° angle line 137 meets the respective points of tangency of a single radius surface 133 with the planar clamping surface and internal side wall at 138, 139.

A larger surface area compound curvilinear entrance zone provided by the present invention is shown at 140. Comparison to single-radius surface 133 shows that multiple-radii surface 140 provides for a more gradual movement of the can stock sheet material from the planar clamping surface into the entrance zone; and, also for a more gradual movement of the can stock sheet material from the entrance zone into the side wall of the draw die.

The multiple-radii concept for increasing the surface area of the cavity entrance zone is carried out, in the specific embodiment being described, by selecting a radius equal to or greater than 0.04" as a larger radius for the multiple-radii surface. Such larger radius ($R_L$, FIG. 22) provides the more gradual movement from the planar clamping surface into the cavity entrance zone; and, also, the more gradual movement of the can stock from the entrance zone into the interior side wall of the cavity.

A smaller radius ($R_s$) which is approximately five times thickness gage of the can stock sheet material, with a designated maximum, is used to establish a compound curvilinear surface intermediate such larger radius ($R_L$) portions at the arcuate end portions of the entrance zone surface; i.e. centrally located of such compound curvilinear surface area.

This multiple-radii, increased-surface-area concept, along with the recessed taper concept for the draw die internal side wall, are embodied in structure as shown in FIG. 22. A portion of the compound curvilinear surface 140 is formed about center 143 using larger radius $R_L$ (0.04" and above); such surface portion 142 is tangential to the planar clamping surface 144 of the draw die. Such larger radius is used about center 145 to provide curvilinear surface 146 leading into the internal side wall of the cavity.

To derive the loci of points for the centrally located smaller radius ($R_s$) of curvature portion of the compound curvilinear surface, the arcs of the larger radii surfaces 142, 146 are extended to establish an imaginary point 148 at their intersection. Connecting imaginary point 148 with midpoint 149 of an imaginary line 150 between the $R_L$ centers 143, 145 provides the remaining point for establishing the loci of points (line 152) for the center of the smaller radius ($R_s$) of curvature; the latter will provide a curvilinear surface 154 which is tangential to both larger radius ($R_L$) curvilinear surfaces 142 and 146.

Typically, for the can sizes and materials discussed above, the larger radius ($R_L$) of curvature would be 0.04" and above, in the range of 0.040" to 0.060", and the smaller radius ($R_s$) of curvature would be less than 0.040", e.g. in the range of 0.020" to 0.030". For example, an increased compound curvilinear surface area entrance zone for can stock of about 0.006" gage, for which a single-radius of curvature of about 0.028" would provide a suitable entrance zone, would be formed with an $R_L$ of 0.040" and an $R_s$ of 0.020". The projection on the clamping plane would remain at 0.028".

In the multiple-radii configurations of the present invention, the smaller radius ($R_s$) curvilinear surface occupies at least about ⅓ of the compound curvilinear surface area and is located intermediate the larger $R_L$ surfaces. In the $R_L$=0.040", $R_s$=0.020" embodiment, the $R_s$ curvilinear surface occupies slightly in excess of 37% of the total surface area of a 90° arc between the clamping surface and internal side wall of the draw die; and, each of the $R_L$ surfaces occupies slightly less than 32% of the surface area in such a 90° arc.

However, in order to provide a 1° recessed taper for the internal side wall, the arc between the planar clamping surface and the internal side wall of the draw die is increased by 1°; such 1° arc increase being added at the internal side wall end of the arc. Such added 1° of arc enables the internal side wall to be recess tapered 1°; and enables such side wall surface to be tangent to the compound curvilinear surface at point 155, i.e. 1° beyond the 90° point of tangency (139). A tangential recess-tapered internal side wall cannot be provided without such added arc provision as described immediately above.

The location of such 1° recessed tapered internal side wall surface, in a radially oriented plane which includes the centerline axis of the draw cavity, is shown at line 156 in relation to a non-tapered side wall surface indicated by line 157.

Profiling of the bottom wall is used with one-piece can bodies because of the internal vacuum and pressure conditions which may be experienced. Profiling of a side wall is used to provide vacuum and crush-proof strength for vacuum packed cans. In accordance with the present invention, bottom wall profiling is carried out after a final-redraw can body is free from drawing operations so as to eliminate stress or strain on side wall sheet material during profiling. The configuration for the end wall profile can be in accordance with that shown in U.S. Pat. No. 4,120,419 of Oct. 7, 1978, which is included herein by reference. The profiling of unitary end wall 102 (FIG. 16) is provided by the end wall of the final redraw punch, as described in more detail later herein; a centrally located panel 103 with circumscribing profile rings 104, 105 are provided. The unitary end wall panel 102 is recessed from bottom peripheral edge 106 by circular ring profiling 107 so that, under pressure, the central panel can move axially toward the exterior of the can body without disturbing upright stability of the can. Under vacuum conditions, the ring profiling enables the panel 103 to move toward the interior of the can. Also, the bottom wall profile of FIG. 16 sacrifices less can volume than an interior dome-shaped profile; e.g. the normal four-inch height for a condensed soup can (211×400) can be reduced to a height of 3-15/16" through use of the deep drawn can body of FIG. 14.

Can 108 of FIG. 17 includes chime seam 109 attaching closure 110 to the one-piece can body; closure 110 is provided with profiling of a type similar to the closed end wall, i.e. with a centrally located panel 111 which can move axially under internal vacuum or pressure conditions due to cooperation of profiling rings 112, 113 and the recessed central panel.

Chime seam 109 adds to the overall diameter of the can. As is generally known, this added diameter must be taken into consideration to provide for straight-line rolling of a can during content processing, such as heat treatment. A "chime profile" or "roll bead" 114, to provide a diameter substantially equal to that of the chime seam 109, is used for such purposes. Eccentrically mounted tooling, the operation of which is known in the art is inserted into and rotated within the can body for side wall profiling.

Rib profiling 116, located contiguous to mid-side wall height, can be conventional side wall profiling as used with certain three-piece cans.

FIG. 18 shows the profiling used for a two-piece drawn carbonated beverage can 117 in accordance with the invention. In order to be able to use light gage sheet metal, e.g. 50 #/bb flat-rolled steel for such cans, and to provide adequately for the high internal pressure during pasteurization of pressurized contents, a bulb profile is utilized for unitary bottom end wall 118. Note that side wall profile 119 (produced by a die-sizing operation) decreases bottom wall diameter and decreases the cross-sectional area of end wall 118 which must withstand internal pressure. Loss of volume, due to this decrease in side wall diameter near the bottom wall, is more than offset by the added volume of the bulb configuration of end wall 118. The bottom bulb and side wall profiling 119 can be carried out during a single press stroke after completion of final redraw.

Reduced-diameter side wall portion 119 is provided to accommodate a fixed plastic coaster having an exterior periphery equal in diameter to the main body side wall; such plastic coaster adds to upright stability without distorting overall side wall diameter. However, for stability purposes during can body storage or can processing, protrusions 125, 126 and 127, shown in FIGS. 18 and 19, are formed in the bottom wall; these provide a tripod on which the can body can stand upright notwithstanding the bulb configuration bottom wall.

A necked-in chime seam 128 at the open end of the can body attaches closure 130, which can be of the easy-open type (not shown), without distorting overall side wall diameter.

In carrying out a final redraw for a sanitary food can body as shown in FIG. 16, the compound curvature transition zone is reshaped as described earlier in relation to FIGS. 7–12. Bottom profiling is carried out at the final redraw station after the final redraw forming is completed and after the can body is released from clamping action.

Figure 23:
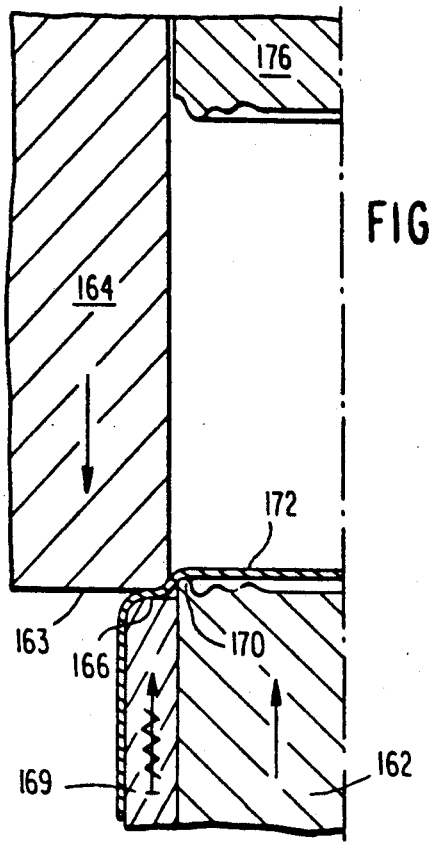
Figure 24:
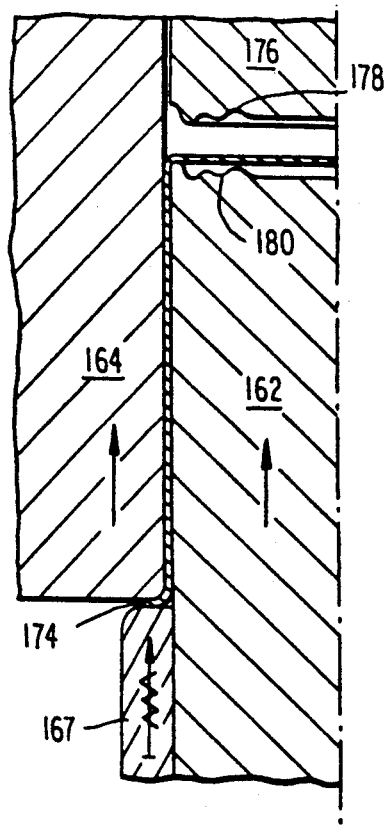

FIGS. 23 through 26 depict final redraw tooling for redrawing a cup-shaped work product and countersinking of the end wall upon completion of redraw. As shown in FIG. 23, such reshaping of the compound curvature juncture of the previous cup has been completed and the metal which is peripheral to upwardly moving redraw punch 162 is being clamped solely between the planar clamping surface 163 of draw die 164 and upper planar surface 166 of clamping ring 167; such clamping is free of nesting curvilinear clamping surfaces as taught in the prior art. The new diameter is being redrawn about the peripheral portion 170 of final redraw punch 162 so that the end wall 172 is planar at this time.

As the redraw is approaching completion (FIG. 24), the redraw punch 162 and redraw die 164 are moving in the same direction with redraw punch 162 moving at a faster rate. Final redraw forming is controlled to present flange metal 174 before release of clamping action. Male profile member 176 is fixed so that no coaction between its profiling surface 178 and the recessed profiling surface 180 of draw punch 162 has started.

Figure 25:
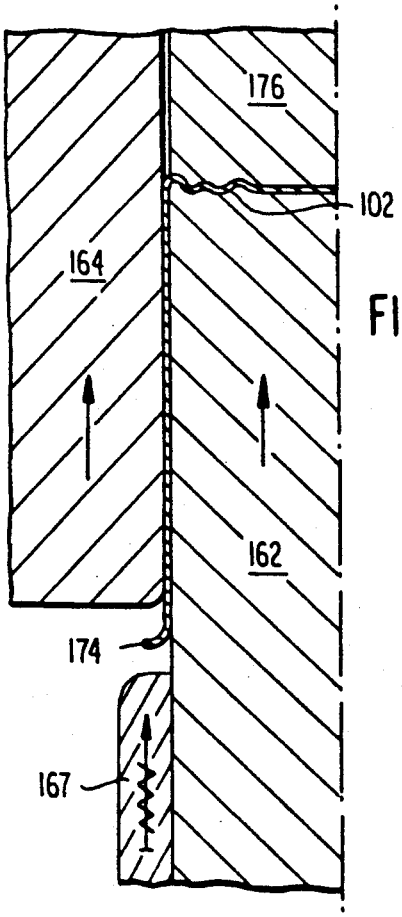

As shown in FIG. 25, clamping action has been released as draw die 164 moves upwardly. As clamping action is released, final redraw punch 162 approaches and reaches top dead center of its upward stroke countersinking the end wall 102 in cooperation with fixed male profile member 176. Such countersinking takes place through movement of side wall metal into such end wall; prior release of clamping action is provided to avoid damage to the sheet metal due to such movement. Final redraw punch 162 is then withdrawn downwardly.

Figure 26:
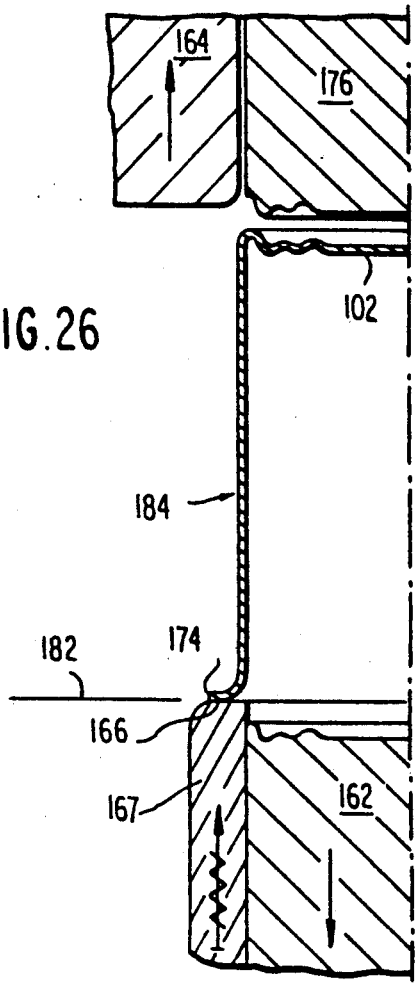

As shown in FIG. 26, upon completion of redraw forming and end wall countersinking operations, the upper planar clamping surface 166 of clamping ring 167 is positioned in the pass line 182 to support flange metal 174 at the open end of work product 184 providing for movement in the pass line for exit from the press. Redraw punch 162 is moving downwardly below the pass line and redraw die 164 is moving upwardly above the closed end of the redrawn can body.

Flat-rolled sheet metal for the can body applications taught by the present invention can comprise flat-rolled steel of nominal thickness gage between 0.005" to 0.012", i.e. about 50 to 110 #/bb in which thickness tolerances are generally within 10%, and nominal flat-rolled aluminum thickness gages between about 0.005" and 0.015"; both surfaces of such flat-rolled sheet metal are organically coated.

Double-reduced plate, because of its as cold-reduced hardness is a preferred flat-rolled steel since the high tensile strength developed in the substrate during cold reduction makes the substrate subject to minimum modification of its properties during draw and redraw operations. However, single-reduced plate can be utilized. The preferred substrate surface for flat-rolled steel for adhesion of organic coating is "TFS" (tin free steel) which comprises a thin plating of chromium. However, with the present invention, deep drawing of flat-rolled steel with other substrate surfaces for organic coating, such as chromium oxide from a cathodic dichromate (CDC) treatment, can also be utilized without detriment to the organic coating. Such "tin mill product" materials and specifications are known in the art, see e.g. "Tin Mill Products", published by the American Iron & Steel Institute, 1000 16th Street N.W., Washington, D.C. 20036, November 1982, or "Steel in Packaging" published by the Committee of Tin Mill Products Producers of the American Iron & Steel Institute; the latter includes can and can body manufacturing nomenclature, and describes prior art manufacture of can bodies by draw-redraw and drawing and ironing processes.

The ability to manufacture deep-drawn can bodies without damage to precoated organic coatings is an important advantage of the present invention. No special properties are required for the organic coatings to withstand deep drawing as taught herein; conventional vinyl organosols, epoxies, phenolics, polyesters and acrylics, applied in a conventional manner to conventional sheet metal substrate surfaces for such coatings to conventional weight per unit area specifications, can be utilized; typical organic coating weights are about four to twelve milligrams per square inch on the sheet metal surface for the can body interior and about one and one-half to six milligrams per square inch on the sheet metal surface for the can body exterior. Such organic coatings are available commercially from companies such as the Midland Division of The Dexter Corporation, East Water Street, Waukegan, Ill. 60085, or The Valspar Corporation, 2000 Westhall Street, Pittsburgh, Pa. 15233. All beer and carbonated beverage cans, regardless of organic coating, are conventionally spray coated internally with enamel which is available from the same commercial sources. The quality of the organic coating surface is maintained when precoated ca stock is fabricated in accordance with the invention so that the need for enamel spray coating of the interior surface of carbonated beverage can bodies may be questioned; however, such coating can be applied in accordance with specifications presently pre scribed by the carbonated beverage market.

Can body handling line equipment and profiling machinery, etc., and can-making presses with which the present tooling apparatus teachings can be utilized, are known in the art and available through various commercial sources, such as Standun Inc., Rancho Dominquez, Calif. 0221.

While specific can bodies and cans, tooling dimensions, sheet metal material and coating specifications have been set forth in describing the invention, those skilled in the art will recognize that modifications in specifically mentioned values can be utilized in the light of the present teachings. Therefore, for purposes of determining the scope of the present invention, reference shall be had to the appended claims.

I claim:

1. Apparatus for drawing pre-coated flat-rolled sheet metal can stock into a one-piece cup for use in the manufacture of a two-piece cylindrical can, comprising can stock supply means providing flat-rolled sheet metal of preselected gage coated on both its planar surfaces with an organic coating, such organic coating surfaces being lubricated with draw lubricant, means for cutting a circular blank of predetermined diameter from such can stock, cupping means including draw die means disposed during usage on one planar surface side of such blank, and cupping punch means and clamping ring means disposed during usage on the remaining opposite planar surface side of such blank;

such draw die means including a cupping cavity having an internal side wall disposed in symmetrical relationship about the centerline axis of the cavity which intersects the geometrical center of such circular blank during cup forming operations, can stock clamping means limited to a planar clamping surface in perpendicularly transverse relationship to such centerline axis, and a compound curvilinear cavity entrance zone between such planar clamping surface and such internal side wall surface, such die means planar clamping surface being disposed radially exterior of and contiguous to such cavity entrance zone, such cavity entrance zone including a compound curvilinear surface having a radius of curvature measured in a radial plane which includes such centerline axis of about five times nominal sheet metal starting gage, such cupping punch means including a cylindrical configuration punch which is aligned during usage for relative movement into such cupping cavity along a travel path in which its centerline axis is directionally coincident with the centerline axis of the cupping cavity, such cylindrical configuration punch including an end wall symmetrically disposed in relation to such centerline axis presenting a peripheral portion disposed in a plane which is perpendicularly transverse to the centerline axis of such punch, a cylindrical configuration peripheral side wall symmetrically disposed with relation to the centerline axis of such punch, and a curvilinear transition zone between such punch end wall and side wall, such punch transition zone having a compound curvilinear surface area which is selected in relation to punch diameter to be as large as possible while avoiding forming buckles in such sheet metal of preselected gage during cup drawing operations;

such clamping ring means including a toroidal configuration clamping ring circumscribing such punch with clamping means being limited to a planar clamping surface radially exterior of and contiguous to such punch for clamping such can stock in a plane which is perpendicularly transverse to the centerline axis of such punch;

such punch being moved during usage into such cupping cavity with such circular blank being clamped radially exterior of such punch and cavity solely between said planar clamping surfaces of the draw die means and clamping ring to form a cup-shaped work product, such cup-shaped work product having a closed end wall presenting a peripheral portion lying in a plane which is perpendicularly transverse to such centerline axis, a substantially cylindrical side wall having a predetermined diameter which is about 25% to 40% less than such circular blank diameter, such side wall having a uniform height in extending from such closed end wall toward the axially opposite open end of such cup-shaped work product, flange metal extending about substantially the full periphery of such cup-shaped work product at its open end, such flange metal being disposed in a plane which is substantially perpendicularly transverse to the centerline axis of such cup-shaped work product, and a compound curvature juncture between such cup end wall and side wall having an interior surface area corresponding to the compound curvilinear surface area of such cupping punch transition zone.

2. The apparatus of claim 1 in which such sheet metal is selected from the group consisting of flat-rolled steel of a thickness gage between about 0.005" and 0.012" and flat-rolled aluminum of a thickness gage between about 0.005" and 0.015", and such circular blank diameter is selected to enable deep drawing a final can body having a diameter in the range of about two to about four and one-quarter inches and a side wall height between about one and one-half inches to five inches.

3. The apparatus of claim 2 in which such cupping cavity side wall has a diameter of about 4.5", such cupping punch curvilinear transition zone has a radius of curvature of about 0.275" measured in a radially oriented plane which includes the centerline axis of such punch, and such compound curvilinear surface included in the cavity entrance zone has a maximum radius of about 0.04".

4. Apparatus for redrawing the cup-shaped work product of claim 1, 2 or 3 into a can body of decreased diameter and increased side wall height in relation to corresponding dimensions of such cup-shaped work product, comprising redraw means including redraw die means disposed during usage on the exterior surface side of such cup-shaped work product in symmetrical relationship to its centerline axis, and redraw punch means and clamping ring means disposed toward the interior surface side of such cup-shaped work product in symmetrical relationship to its centerline axis;

such redraw die means defining a redraw cavity having an internal side wall which is symmetrically disposed with relation to the centerline axis of such cavity, and having solely planar clamping means presenting a planar redraw die clamping surface, and a compound curvature redraw cavity entrance zone between such redraw internal side wall and such planar clamping surface, such planar redraw die clamping surface being disposed radially exterior of and contiguous to such cavity entrance zone in a plane which is perpendicularly transverse to the centerline axis of such redraw cavity, such redraw cavity entrance zone including a compound curvilinear surface having a radius of curvature measured in a plane which includes such cavity centerline axis which is about five times nominal starting gage.

such redraw punch means including a cylindrical configuration redraw punch which is symmetrical with respect to its centerline axis and aligned during usage for relative movement into such redraw cavity along a travel path in which its centerline axis is directionally coincident with the centerline axis of the redraw cavity, such redraw punch including an end wall presenting a peripheral portion disposed in a plane which is perpendicularly transverse to its centerline axis, a substantially cylindrical side wall symmetrical with its centerline axis and having a diameter providing for sheet metal clearance during relative movement of such redraw punch into such redraw cavity while decreasing such cup-shaped work product diameter by about 15% to 30%, and a compound curvature transition zone of predetermined surface area between such redraw punch end wall and side wall;

such redraw clamping ring means presenting a substantially toroidal configuration clamping ring symmetrically disposed during usage radially exterior of and contiguous to such redraw punch;

such toroidal configuration clamping ring providing for solely planar clamping of can stock during redraw, and presenting a planar end wall clamping surface disposed in a plane perpendicularly transverse to the centerline axis of such redraw punch, a substantially cylindrical configuration outer periphery side wall, symmetrical to such centerline axis of the redraw punch, and having a diameter which is approximately equal to the internal diameter of such cup-shaped work product side wall while allowing for tool clearance, and a compound curvilinear transition zone between such planar end wall clamping surface and such clamping ring peripheral side wall, such redraw clamping ring transition zone, as projected onto a clamping surface plane which is perpendicularly transverse to such centerline axis of the first-redraw punch, occupying less than about 40% of a corresponding projection of such compound curvilinear juncture of the cup-shaped work product onto such clamping surface plane, such that upon movement of such redraw clamping ring and punch, along such travel path in which such punch centerline axis is directionally coincident with the centerline axis of the redraw cavity, the configuration of such compound curvilinear juncture of the cup-shaped work product is initially reshaped to that of the redraw clamping ring compound curvilinear transition zone and can stock is clamped radially outwardly of and contiguous to such redraw punch solely between said planar clamping surfaces of such redraw die means and redraw clamping ring as such redraw punch is moved into such redraw cavity to form a redrawn can body;

such redrawn can body having a closed end wall having a peripheral portion lying in a plane which is perpendicularly transverse to the centerline axis of such can body, a cylindrical configuration side wall having a predetermined diameter which is between about 15% to 30% less than such cup-shaped work product diameter, such redrawn can body having a uniform height in extending from its closed end wall toward its axially opposite open end, flange metal extending about the full periphery of such redrawn can body about its open end, such flange metal being disposed at completion of such redraw in a plane which is substantially perpendicularly transverse to the centerline axis of such redrawn cup, and a side wall height which is greater than side wall height of such cup-shaped work product, and a compound curvilinear juncture between such redrawn can body end wall and side wall having an interior surface area which is approximately equal to the surface area of such redraw punch compound curvilinear transition zone.

5. The apparatus of claim 4 for use in double-redraw can body fabrication in which such redraw punch compound curvilinear transition zone has a radius of curvature selected in relation to such redraw punch diameter to be as large as possible while avoiding forming buckles in such sheet metal of preselected gage.

6. The apparatus of claim 4 in which such redraw punch compound curvilinear transition zone has a radius of curvature of about 0.06" to about 0.2", and such compound curvature surface included in such draw die cavity entrance zone has a maximum radius of 0.040".

7. The apparatus of claim 4 for use in single-redraw can body fabrication in which such redraw punch compound curvature transition zone has a radius of curvature selected to provide a desired radius of curvature juncture configuration at the closed end of such can body, and such redraw punch end wall includes end wall profiling means recessed axially from and located radially inwardly of such end wall peripheral portion which is disposed in a plane perpendicularly transverse to such centerline axis.

8. Apparatus for carrying out a final redraw of the redrawn cup-shaped work product of claim 4 into a can body of decreased diameter and increased side wall height in relation to such redrawn work product, comprising final redraw means including final redraw die means disposed during usage on the exterior surface side of such redrawn work product in symmetrical relationship to the centerline axis thereof, and final redraw punch means and clamping ring means disposed during usage toward the interior surface side of such redrawn work product in symmetrical relationship to its centerline axis;

such final redraw die means defining a final redraw cavity having an internal side wall which is symmetrically disposed with relation to the centerline axis of such cavity and having a circular configuration in a plane perpendicularly transverse to such axis, and providing for solely planar clamping by presenting a final redraw planar clamping surface disposed radially exterior of and contiguous to such final redraw cavity in a plane which is perpendicularly transverse to such centerline axis of such cavity, and a compound curvilinear cavity entrance zone between such final redraw cavity side wall and such final redraw planar clamping surface, such final redraw cavity entrance zone including a compound curvilinear surface having a radius of curvature of about five times nominal sheet metal starting gage, such final redraw punch means including a substantially cylindrical configuration final redraw punch which is symmetrical with respect to its centerline axis and aligned during usage for relative movement into such final redraw cavity along a travel path in which its centerline axis is directionally coincident with the centerline axis of the final redraw cavity, such final redraw punch including an end wall having a periphery for presenting a surface disposed in a plane which is perpendicularly transverse to its centerline axis, a side wall having a circular configuration in a plane perpendicularly transverse to its centerline axis and a diameter providing for sheet metal clearance during relative movement of such final redraw punch into such final redraw cavity while decreasing such redrawn work product diameter between about 15% and 30%, and a compound curvilinear transition zone of predetermined surface area between such final redraw punch end wall and side wall, such final redraw clamping ring means presenting a substantially toroidal configuration clamping ring symmetrically disposed during usage radially exterior of and contiguous to such final redraw punch, such toroidal configuration clamping ring providing for solely planar clamping during redraw and presenting a planar end wall clamping surface disposed in a plane perpendicularly transverse to the centerline axis of such final redraw punch, such final redraw clamping ring further including a substantially cylindrical configuration peripheral side wall, symmetrical to such centerline axis of the final redraw punch, of a diameter which is approximately equal to the internal diameter of such redrawn can body side wall while allowing for tool clearance, and a compound curvilinear transition zone for such final redraw clamping ring between its planar end wall clamping surface and its outer periphery side wall surface, such final redraw clamping ring curvilinear transition zone as projected onto a clamping surface plane which is perpendicularly transverse to such centerline axis of the final redraw punch occupying less than about 40% of the projection of such curvilinear juncture between the end wall and side wall of the redrawn can body onto such clamping surface plane, such that upon movement of such final redraw die means along such travel path in which such final redraw cavity punch centerline axis is directionally coincident with the centerline axis of the final redraw punch, such compound curvilinear juncture at the closed end of such redrawn can body is initially reshaped to that of the final redraw clamping ring curvilinear transition zone with can stock radially outwardly of and contiguous to such final redraw punch being clamped solely between said planar clamping surfaces of such final redraw die means and final redraw clamping ring as such final redraw punch is moved into such final redraw cavity to form such final redrawn can body, such final redrawn can body including a closed end wall, a cylindrical configuration side wall having a predetermined diameter which is about 15% to 30% less than the diameter of such redrawn can body, such final redraw can body having a uniform height in extending from such final redraw can body closed end toward the axially opposite open end of such can body, flange metal extending about the full periphery of such final redraw can body about its open end, such flange metal being disposed at completion of such final redraw in a plane which is substantially perpendicularly transverse to the centerline axis of such final redraw cup, and a side wall height which is greater than the height of the side wall of such redrawn work product, and a compound curvilinear juncture between such final redraw end wall and side wall having an interior surface area which is approximately equal to the surface area of such final redraw punch curvilinear transition zone.

9. The apparatus of claim 8 in which such final redraw punch compound curvilinear transition zone has a radius of curvature of about 0.06", and such compound curvilinear surface included in such draw die cavity entrance zone has a maximum radius of 0.040".

10. The apparatus of claim 4 in which such redraw clamping ring transition zone has a compound curvature surface formed above multiple radii of differing length measured in a radially oriented plane which includes such redraw punch centerline axis.

11. The apparatus of claim 8 in which such final redraw clamping ring transition zone has a compound curvature surface formed about multiple radii of differing length measured in a radially oriented plane which includes such redraw punch centerline axis.

12. Method for drawing pre-coated flat-rolled sheet metal can stock into a one-piece cup for use in the manufacture of a two-piece cylindrical can, comprising providing can stock of preselected gage flat rolled sheet metal pre-coated on both its planar surfaces with an organic coating, both such organic coating surfaces being lubricated with draw lubricant, cutting a circular blank of predetermined diameter from such can stock, providing cupping means including draw die means, cupping punch means, and clamping ring means, disposing such draw die means on one planar surface side of such circular blank, such draw die means including a cupping cavity having a centerline axis, can stock clamping means limited to a planar clamping surface, and a compound curvilinear cavity entrance zone between such cavity and planar clamping surface, such cavity entrance zone including a compound curvilinear surface having a radius of curvature of about five times starting thickness gage for such sheet metal, such die means cupping cavity having an internal side wall in symmetrical relationship about such centerline axis of the cupping cavity and of circular configuration in a plane perpendicularly transverse to such axis, disposing such cupping cavity with its centerline axis intersecting the geometrical center of such circular blank, with such die means planar clamping surface being disposed radially exterior of and contiguous to such cupping cavity entrance zone in a plane which is perpendicularly transverse to the centerline axis of the cupping cavity, disposing such cupping punch means and clamping ring means on the remaining opposite planar surface of such circular blank;

such cupping punch means presenting a substantially cylindrical configuration punch, aligning such punch for relative movement into such cupping cavity along a travel path in which its centerline axis is directionally coincident with the centerline axis of the cupping cavity, such punch including an end wall symmetrically disposed in relation to such punch centerline axis presenting a peripheral surface defining a plane which is perpendicularly transverse to such axis, a substantially cylindrical configuration peripheral side wall symmetrically disposed with relation to the centerline axis of such punch, and a compound curvilinear transition zone between such punch end wall planar surface and such punch cylindrical side wall, selecting such punch side wall to have a predetermined diameter which is about 25% to 40% less than such predetermined diameter of such circular blank, selecting a surface area for such punch curvilinear transition zone to be as large as possible in relation to punch diameter while avoiding forming buckles in such sheet metal of preselected gage during a cup drawing operation;

disposing such clamping ring means to circumscribe such punch providing can stock clamping means limited to a planar clamping surface radially exterior of and contiguous to such punch for clamping such can stock in a plane which is perpendicularly transverse to the centerline axis of such punch, providing relative movement of such punch into such cupping cavity with such circular blank being clamped radially exterior of such punch and cavity solely between said planar clamping surfaces of the draw die means and clamping ring to draw form a cup-shaped work product, such cup-shaped work product having a closed end wall having a periphery lying in a plane perpendicularly transverse to its centerline axis, a substantially cylindrical side wall having a predetermined diameter which is about 25% to 40% less than such circular blank diameter, and a compound curvilinear juncture between such cup end wall and side wall having an interior surface area corresponding to such preselected surface area of such cupping punch curvilinear transition zone, such cup side wall having a uniform height in extending from such closed end wall toward the axially opposite open end of such cup, interrupting such relative movement of such punch into such cupping cavity to provide flange metal extending about substantially the full periphery of such cup at its open end, such flange metal being disposed in a plane which is substantially perpendicularly transverse to the centerline axis of such cup.

13. The method of claim 12 including the step of selecting such can stock sheet metal from the group consisting of flat-rolled steel of a nominal thickness gage between about 0.005" and 0.012" and flat-rolled aluminum of a nominal thickness gage between about 0.005" and 0.015", and selecting such circular can stock blank diameter to enable deep drawing a final can body having a diameter in the range of about two to about four and one-quarter inches and a side wall height between about one inch and five inches with sufficient flange metal for forming a chime seam to attach an end wall closure to such open end of such can body.

14. The method of claim 13 including providing a cupping punch having a curvilinear transition zone with a radius of curvature of about 0.275", and such compound curvilinear surface included in such draw die cavity entrance zone has a maximum radius of 0.040".

15. Method for redrawing the cup-shaped work product of claim 12, 13 or 14 into a can body of decreased diameter and increased side wall height in relation to the diameter and side wall height, respectively, of such cup-shaped work product, comprising uniformly lubricating interior and exterior surfaces of such cup-shaped work product before redrawing such work product, providing redraw means including redraw die means, redraw punch means, and redraw clamping ring means, disposing such redraw die means on the exterior surface side of such cup in symmetrical relationship to the centerline axis of such cup, such redraw die means defining a redraw cavity having an internal side wall which is symmetrically disposed with relation to the centerline axis of such cavity and of circular configuration in a plane perpendicularly transverse to such axis;

providing for solely planar clamping by presenting a redraw die planar clamping surface disposed radially exterior of and contiguous to such redraw cavity in a plane which is perpendicularly transverse to such centerline axis of such cavity, such redraw die means having a redraw cavity entrance zone of compound curvilinear configuration between such redraw die internal side wall and such redraw die planar clamping surface, selecting such redraw cavity entrance zone to include a compound curvilinear surface having a radius of curvature of about five times starting thickness gage of such sheet metal.

disposing such redraw punch means and redraw clamping ring means toward the interior surface side of such cup-shaped work product in symmetrical relationship to its centerline axis;

such redraw punch means including a substantially cylindrical configuration redraw punch which is symmetrical with respect to its centerline axis, aligning such redraw punch for relative movement into such redraw cavity along a travel path in which its centerline axis is directionally coincident with the centerline axis of the redraw cavity, such redraw punch including an end wall presenting a peripheral surface disposed in a plane which is perpendicularly transverse to its centerline axis, a substantially cylindrical surface peripheral side wall symmetrical with its centerline axis, and a compound curvilinear transition zone of preselected surface area between such redraw punch end wall and such punch side wall;

selecting such first-redraw punch to have a diameter providing for sheet metal clearance while providing relative movement of such redraw punch into such redraw cavity to decrease such work product cup diameter by about 15% to 30%;

such redraw clamping ring means presenting a substantially toroidal configuration clamping ring, selecting such toroidal configuration clamping ring to provide solely planar clamping of can stock during redraw by presenting a planar end wall clamping surface disposed in a plane perpendicularly transverse to the centerline axis of such redraw punch, disposing such redraw clamping ring radially exterior of and contiguous to such redraw punch in symmetrical relationship to such redraw punch centerline axis, such toroidal configuration clamping ring including a substantially cylindrical configuration peripheral side wall which is symmetrical with such centerline axis of the redraw punch, and a compound curvilinear transition zone between such planar end wall clamping surface and peripheral side wall of such redraw clamping ring, selecting such clamping ring peripheral side wall to have a diameter which is approximately equal to the internal diameter of such cup-shaped work product side wall while allowing for tool clearance;

selecting such redraw clamping ring curvilinear transition zone so that as projected onto a clamping surface plane, which is perpendicularly transverse to such centerline axis of the first-redraw punch, it occupies less than about 40% of the projection of such compound curvilinear juncture of such cup-shaped work product onto such clamping surface plane;

providing relative movement of such redraw clamping ring and punch, along such travel path in which the centerline axis of such punch is directionally coincident with the centerline axis of the redraw cavity, so as to initially reshape the configuration of such compound curvilinear juncture of such cup-shaped work product to that of the redraw clamping ring compound curvilinear transition zone, and provide for clamping sheet metal radially outwardly of and contiguous to such redraw punch solely between said planar clamping surfaces of such redraw die means and redraw clamping ring as such redraw punch is moved into such redraw cavity to form a redrawn can body, such redrawn can body having a closed end wall, a substantially cylindrical configuration side wall having a predetermined diameter which is between about 15% to 30% less than such work product cup diameter, such redrawn can body having a uniform height in extending from its closed end wall toward its axially opposite open end with a side wall height which is greater than the height of the side wall of such starting cup-shaped work product, and a compound curvilinear juncture between such redrawn can body end wall and side wall having an interior surface area which is approximately equal to such preselected surface area of such redraw punch compound curvilinear transition zone; and interrupting relative movement of such redraw punch into such redraw cavity so as to provide flange metal extending about the full periphery of such redrawn can body about its open end, such flange metal being disposed at completion of such first-redraw in a plane which is substantially perpendicularly transverse to the centerline axis of such first-redraw cup.

16. The method of claim 15 for use in carrying out a double-redraw can body fabrication in which such redraw punch curvilinear transition zone has a surface area preselected in relation to such redraw punch diameter to be as large as possible while avoiding forming buckles in the selected sheet metal.

17. The method of claim 16 in which such redraw punch compound curvilinear transition zone has a radius of curvature of about thirty times sheet metal starting gage.

18. The method of claim 15 for use in single redraw can body fabrication including preselecting such redraw punch compound curvilinear transition zone to have a radius of curvature which is about ten times sheet metal starting gage.

19. Method for carrying out a final redraw of the redrawn work product of claim 15 into a can body of decreased diameter and increased side wall height in relation to corresponding dimensions of such redrawn can body, comprising uniformly lubricating such redrawn cup-shaped work product interior and exterior surfaces prior to further redraw, providing final redraw means including final redraw die means, a final redraw punch, and a final redraw clamping ring, disposing such final redraw die means on the exterior surface side of such redrawn work product in symmetrical relationship to the centerline axis thereof, such final redraw die means being selected to define a final redraw cavity having an internal side wall which is symmetrically disposed with relation to the centerline axis of such cavity and of circular configuration in a plane perpendicularly transverse to such axis, provide for solely planar clamping by presenting a final redraw planar clamping surface disposed radially exterior of and contiguous to such final redraw cavity in a plane which is perpendicularly transverse to such centerline axis of such cavity, and present a cavity entrance zone of compound curvilinear configuration between such final redraw cavity side wall and such final redraw planar clamping surface, such final redraw cavity entrance zone including a compound curvilinear surface having a radius of curvature of about 0.040", or less, measured in a plane which includes such cavity centerline axis, disposing such final redraw punch and clamping ring toward the interior surface side of such redrawn work product in symmetrical relationship to its centerline axis;

aligning such final redraw punch for relative movement into such final redraw cavity along a travel path in which its centerline axis is directionally coincident with the centerline axis of the final redraw cavity, such final redraw punch having a substantially cylindrical configuration which is symmetrical with respect to its centerline axis and including an end wall periphery for defining a planar surface disposed in a plane which is perpendicularly transverse to its centerline axis, a peripheral side wall having a diameter providing for sheet metal clearance during relative movement of such final redraw punch into such final redraw cavity while decreasing such redrawn work product diameter between about 15% and 30%, and a compound curvilinear transition zone between such final redraw punch end wall planar peripheral surface and such peripheral side wall, such final redraw punch curvilinear transition zone being selected to provide a desired curvilinear configuration juncture at the closed end of a final redraw can body between the end wall and side wall of such final redraw can body;

such final redraw clamping ring having a toroidal configuration, disposing such final redraw clamping ring radially exterior of and contiguous to such final redraw punch, such toroidal configuration clamping ring being symmetrical with such final redraw punch for movement in a direction parallel to the centerline axis of such punch, such final redraw clamping ring providing for solely planar clamping of sheet metal during redraw by presenting solely planar end wall clamping surface means disposed in a plane perpendicularly transverse to the centerline axis of such final redraw punch, such final redraw clamping ring further including a substantially cylindrical configuration peripheral side wall having a diameter which is approximately equal to the interior surface diameter of such redrawn work product while allowing for tool clearance, and a compound curvilinear transition zone between such final redraw clamping ring end wall and peripheral side wall;

selecting such final redraw clamping ring curvilinear transition zone so that as projected onto a clamping surface plane, which is perpendicularly transverse to such centerline axis of the final redraw punch, it occupies less than about 40% of the projection of such curvilinear juncture, between the end wall and side wall, of the first-redraw can body onto such clamping surface plane;

providing relative movement of such final redraw clamping ring and punch, along such travel path in which such final redraw punch is directionally coincident with the centerline axis of the final redraw cavity, so as to initially reshape such curvilinear juncture of such redrawn can body to that of the final redraw clamping ring curvilinear transition zone with sheet metal radially outwardly of and contiguous to such final redraw punch being clamped solely between said planar clamping surfaces of such final redraw die means and final redraw clamping ring as such final redraw punch is moved into such final redraw cavity to form such final redraw can body;

such final redraw can body including a closed end wall, a cylindrical configuration side wall having a predetermined diameter which is about 15% to 30% less than the diameter of such first-redrawn can body, such final redraw can body side wall having a uniform height in extending from such final redraw can body closed end toward the axially opposite open end of such can body, a side wall height which is greater than the starting side wall height of such redrawn can body, and a compound curvilinear juncture between such final redraw end wall and side wall having an interior surface area which is approximately equal to the surface area of such final redraw punch curvilinear transition zone; and interrupting relative movement of such final redraw punch into such final redraw die cavity so as to provide flange metal extending about the full periphery of such final redraw can body about its open end, such flange metal being disposed at completion of such final redraw in a plane which is substantially perpendicularly transverse to the centerline axis of such final redraw cup.

20. The method of claim 19 including selecting such curvilinear transition zone of such final redraw punch to have a radius of curvature of about ten times starting gage of such can stock.

* * * * *